US005379536A

United States Patent [19]

Lorenzana

[11] Patent Number: 5,379,536

[45] Date of Patent: Jan. 10, 1995

[54] IRONING BOARD ATTACHMENT INCLUDING BASKET

[76] Inventor: Moises B. Lorenzana, 601 Lake Hinsdale Dr., Willowbrook, Ill. 60514

[21] Appl. No.: 152,580

[22] Filed: Nov. 15, 1993

[51] Int. Cl.[6] ..... D06F 81/10; A47G 23/02; B65D 43/20

[52] U.S. Cl. ..... 38/106; 108/31; 211/181; 220/485

[58] Field of Search ..... 38/104, 106, 107, 111, 38/141, 142; 248/117.1, 117.2, 117.3, 107, 214, 225.31, 271.8, 310, 311.2; 211/74, 86, 119, 123, 181; 108/29, 1, 72, 149; 24/3 D; 223/107, 108; 220/475, 478, 482, 485, 491

[56] References Cited

U.S. PATENT DOCUMENTS

| | | | |
|---|---|---|---|
| D. 236,414 | 8/1975 | Kroll | 220/486 |
| B 390,732 | 1/1975 | Wayne | 38/104 X |
| 920,049 | 4/1909 | Good | 38/142 |
| 1,024,720 | 4/1912 | Cottle | 108/31 |
| 2,241,084 | 5/1941 | Dobbins | 38/104 X |
| 2,635,779 | 4/1953 | Pfeiffer | 220/485 X |
| 2,796,994 | 6/1957 | Saltness | 211/86 |
| 2,831,598 | 4/1958 | Slavsky et al. | 220/485 X |
| 2,944,673 | 7/1960 | Geluso | 108/31 X |
| 3,055,129 | 9/1962 | Selleck | 38/142 X |
| 3,534,865 | 10/1970 | Holliman | 211/86 |
| 3,995,744 | 12/1976 | Metcalf | 211/181 X |
| 4,425,942 | 7/1985 | Azzara | 38/106 |
| 4,535,921 | 8/1985 | Sanders | 223/106 |
| 5,181,621 | 1/1993 | Plaehn | 248/231.8 X |
| 5,249,702 | 10/1993 | Topp et al. | 248/214 X |
| 5,272,825 | 12/1993 | Simpson | 38/106 X |

*Primary Examiner*—Clifford D. Crowder
*Assistant Examiner*—Ismael Izaguirre
*Attorney, Agent, or Firm*—Neil M. Rose

[57] ABSTRACT

An ironing board attachment which is readily detachably mounted on a domestic ironing board having a pressing member with a pressing surface to support ironing supplies adjacent to the pressing surface including a yoke to be received on the pressing member and a basket for receiving such supplies and having a mounting to pivotally connect the basket to the yoke.

11 Claims, 1 Drawing Sheet

Fig. 1
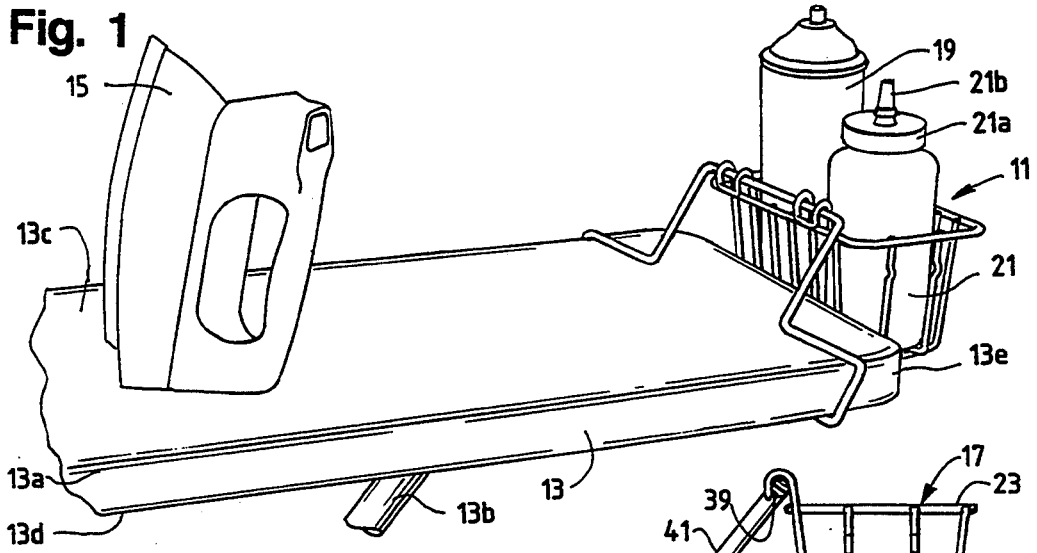
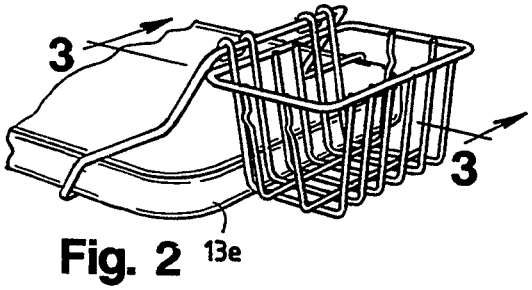
Fig. 2
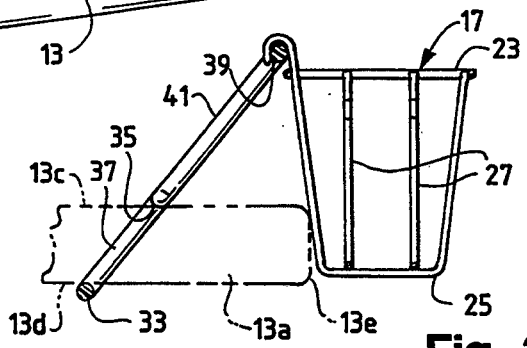
Fig. 3
Fig. 4
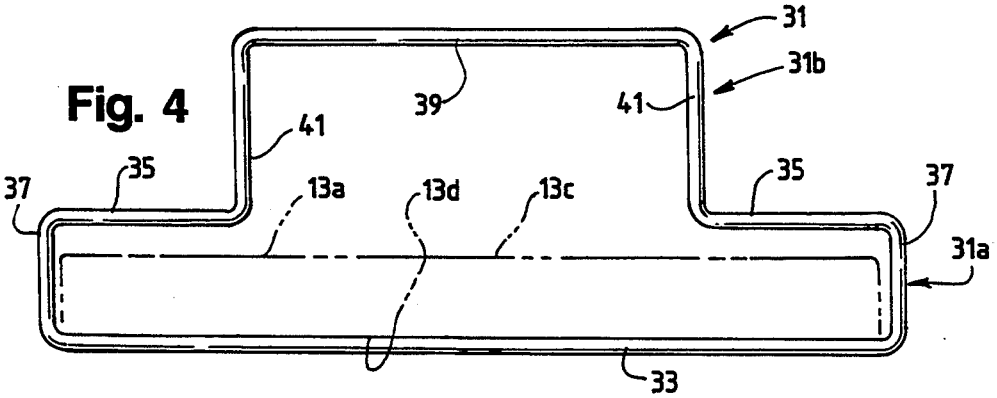
Fig. 5
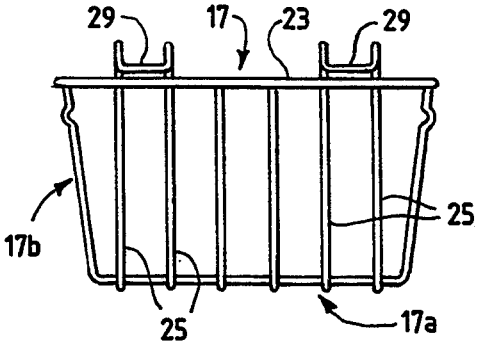
Fig. 6
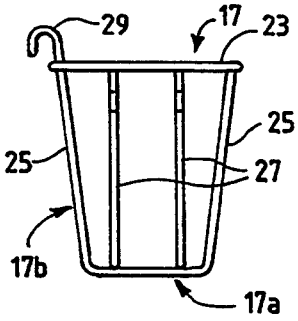

IRONING BOARD ATTACHMENT INCLUDING BASKET

BACKGROUND OF THE INVENTION

The present invention relates generally to domestic clothes pressing or ironing and, more specifically, to an attachment to be used on a domestic ironing board to support in a convenient location certain accessories normally used in the ironing of clothes. It is desirable for one performing the clothes pressing task to have such items as distilled water and spray starch conveniently available so that they may be applied to the clothes or the electric iron without requiring the party to move away from the ironing board. It is important that these items not be positioned on the ironing board where they would be an obstruction to the positioning of clothes on the ironing board.

The ironing of clothes in the home is conventionally accomplished with a portable electric iron used in combination with a portable or collapsible ironing board. The ironing board itself is fairly bulky having a pressing member about four and a half feet long and 15 inches wide with a padded upper pressing surface which is supported in a horizontal plane by a foldable frame. The frame normally includes legs which fold into the plane of the pressing member so that the entire ironing board may be easily stored in an upright position in a closet with the pressing member disposed vertically. Since a considerable amount of effort and design has gone into producing an ironing board design which is compact and easily stored when the legs are folded against the pressing member, it is important that any accessories or attachments used with the ironing board be very compact and removable from the ironing board so as to not interfere with its storage in a restricted area.

The supplies that are most commonly required during the ironing of clothes are starch and distilled water. Starch is available in spray containers and is applied to clothes to make them more stiff and less flexible. Since starch is used very frequently during the ironing process, it is important that it be positioned or stored close at hand where the ironer may reach it without moving from the normal ironing position adjacent to the ironing board. At the same time, it is important that the starch container not be positioned on the pressing surface where it would interfere with the ironing of clothes thereon. Therefore, it is desirable to provide means for supporting the starch container adjacent to but not on the pressing surface of the ironing board.

The distilled water used in electric steam irons is normally purchased at the local super market in one gallon containers. When it becomes necessary to fill the reservoir of the steam iron with distilled water, there is considerable difficulty in pouring the distilled water from the conventional one gallon plastic bottle into the small fill opening provided on the normal steam iron for the filling of the water reservoir. Accordingly, most steam ironers find it necessary to use a funnel or possibly a measuring cup that includes a pouring spout to direct the distilled water from the gallon bottle into the fill opening. Since it is often necessary to replenish the distilled water in the iron several times during one period of ironing, these steps in filling the iron from the gallon bottle represent a significant delay and reduce the efficiency of the ironing operation. It would therefore be desirable to provide a water container which could be stored at a location convenient to the pressing surface and which would include a pouring spout to facilitate dispensing the distilled water directly from the container into the steam iron reservoir.

There are patents which disclose various types of ironing board attachments, some of which are intended to support spray starch containers positioned conveniently with respect to an ironing board. Included in these patents are the Sanders U.S. Pat. No. 4,535,921 and the Azzara U.S. Pat. No. 4,525,942. The patent to Sanders discloses a small, upright container having a spring clip to secure it to the downwardly extending side wall of the ironing board pressing member; the container is of appropriate size to receive a starch container. The patent to Azzara discloses a basket 34 which is adapted to receive a spray can of starch 36. The basket is attached to the end of the ironing board by a bracket 24 which lays across a rail 12 secured to the board by brackets 14 and the spring 18. The apparatus of the Azzara patent is fairly complex being difficult to assemble to the ironing board and being positioned to interfere with the draping of clothes across a substantial portion of one end of the ironing board.

The published patent application to Wayne No. B 390,732 published Jan. 28, 1975 discloses an ironing board attachment designed to clamp to the pressing member of the ironing board by means of one or more finger operated screws 77. The attachment includes a basket 21 adapted to receive a starch can 65. The Wayne application recognizes the problem of providing an attachment which does not interfere with the storing of the ironing board by increasing its bulk. The Wayne application solves this problem by having the starch supporting basket separable from the structure for clamping the attachment to the ironing board. This approach is in direct contrast to the present invention in which the entire attachment is easily detachable from the ironing board so as to not interfere with the storage of the ironing board.

The Holliman U.S. Pat. No. 3,534,865 and Saltness No. 2,796,994 are of interest as showing ironing board attachments which are readily detachable from mounted positions on ironing boards. Both of these patents relate to garment supports which have clamping members spring biased into engagement with the opposite edges of a pressing member of an ironing board. The Good U.S. Pat. No. 920,049 discloses an ironing board attachment which is detachably secured to the upper surface of the pressing member by telescoping U-shaped members which engage the opposite edges of the pressing member. None of the above cited items of art disclose a structurally simple ironing board attachment for supporting supplies such as starch and water which is easily detachable from the ironing board and which provides minimum obstruction to the clothes pressing operation.

SUMMARY OF THE INVENTION

The present invention provides a simple ironing board attachment for supporting supplies such as starch and distilled water at a location immediately adjacent to the pressing surface of the ironing board. The attachment includes a supply basket and a support member which is simply and easily applied over the end of the ironing board pressing member to mount the attachment thereon. The support member comprises a continuous loop or yoke of wire formed material coated with plastic material such as P.V.C. The yoke includes a first portion dimensioned to receive one end of the ironing board pressing member while in a plane normal to the pressing surface and then to lock into engagement with the pressing member when inclined slightly from its vertical position. The yoke also includes a second portion having a support bar which extends parallel to the pressing surface when the yoke is in the inclined position on the pressing member and is positioned over the end of the pressing member. The supply basket has a bottom and side walls with an open top to receive water and starch containers. The basket is provided with a laterally extending hook portion which detachably engages the support bar to pivotally connect the yoke and the basket, the yoke being positionable so that the basket rests against the end of the pressing member with the weight of the basket and its contents locking the yoke in position on the pressing member. This weight of the basket and its contents causes the yoke to become wedged tightly against the top and bottom surfaces of the ironing board pressing member. This wedging action locks the attachment firmly in place on the ironing board. Thus there is provided a very structurally simple attachment made of inexpensive wire formed parts which is easily assembled to and disassembled from an ironing board. The support yoke is dimensioned to receive the largest of the domestic ironing board pressing members, that being about 15 inches (38 centimeters) wide and one and one quarter inches (3.17 centimeters) thick. Ironing boards having pressing members as narrow as 10 inches (25.4 centimeters) wide will still be adapted to engage the opposed edges of the first portion of the yoke to secure the attachment in place on the ironing board. The attachment of the present invention is, therefore, adapted for use on all of the domestic ironing boards that are generally available.

The invention preferably includes a supply basket of sufficient size to accommodate two containers, one of which is a commercially available spray starch container. The water container is equal in size to the starch container having a capacity of about twenty ounces with a wide mouth to facilitate filling from a one gallon distilled water bottle. The water container is provided with a screw cap having a tapered nozzle which is adapted to fit into the fill opening of a steam iron to facilitate the dispensing of water from the container into the iron.

Accordingly it is an object of the present invention to provide an improved ironing board attachment which is simple in construction and readily detachable from an ironing board to support ironing supplies in a convenient location without creating substantial obstruction to the pressing surface of the ironing board.

It is a further object of the present invention to provide an improved attachment which is assembled to the ironing board by merely passing the support yoke over the end of the pressing member and hanging the supply basket from the yoke.

It is another object of the present invention to provide an improved ironing board attachment which includes a support yoke formed by a continuous loop having a first and second coplanar portions, with the first portion being of a size to snugly receive the end of an ironing board pressing member and the second portion having a horizontally extending support bar positionable over said end to pivotally connect to the pressing member a supply basket which is hung from the support bar.

It is still another object of the present invention to provide an improved ironing board attachment which is readily detachable from the ironing board and which supports adjacent to the pressing surface of the ironing board ironing supplies such as starch and distilled water in a container having a dispensing nozzle to deliver water into the fill opening of a steam iron.

BRIEF DESCRIPTION OF THE DRAWINGS

While the present invention is described with particularity in the claims annexed to and forming a part of this specification, a better understanding of the invention can be had by reference to the following description taken in conjunction with the accompanying drawings in which:

FIG. 1 is a perspective view of a portion of an ironing board on which there is mounted the ironing board attachment of the present invention.

FIG. 2 is a perspective view of the ironing board and attachment similar to FIG. 1 but from the right end of the ironing board and with the supplies removed from the basket portion of the attachment;

FIG. 3 is a sectional view of the attachment taken substantially along line 3—3 of FIG. 2 with the ironing board shown in dash lines;

FIG. 4 is a plan view of the yoke portion of the attachment of FIGS. 1–3

FIG. 5 is an front elevational view of the supply basket portion of the attachment of FIGS. 1–3; and FIG. 6 is a side elevational view of the supply basket portion of FIG. 5.

DESCRIPTION OF THE PREFERRED EMBODIMENT

Referring to the drawings, there is shown in FIGS. 1 and 2 an ironing board attachment 11 which is shown assembled to an ironing board 13. The ironing board 13 may comprise any conventional domestic ironing board which includes a pressing member **13*a* and a support structure 13*b*. In order for the conventional domestic ironing board to be stored in a closet in as small a space as possible, the support structure 13*b* normally includes legs which are pivoted at one end to the pressing member 13*a* so that they may be folded in against the pressing member 13*a***. As a consequence, when the legs are folded for storage against or into the pressing member, the ironing board may be stored in a vertical position with the assembly occupying very little more space than would be required for storing only the pressing member.

The foregoing explanation of the storage aspects of the ironing board 13 is given to emphasize the importance of having any ironing board attachments easily detachable from the ironing board itself in order to avoid interfering with the feature of compact storability which characterizes the domestic ironing board.

The pressing member **13*a* is provided with an upper or pressing surface 13*c* which is generally padded to some extent to facilitate clothes pressing. The pressing member 13*a* includes an underside 13*d* to which the legs of the support structure 13*b* are pivotally connected. Although not shown in the drawings, it is conventional to provide the pressing member with a tapered end at one end to aid in the insertion of the pressing member into certain articles of clothing being pressed. The pressing member is formed with a flat end 13*e* which is normally the end at which an operator would store an electric iron 15** during periods of nonuse. Since the end 13*e* of the pressing member is the normal location for storing the iron 15, it is also the preferred end at which to store any ironing supplies such as starch and distilled water. It is important to place such supplies in a convenient location with respect to the ironing surface to minimize interruptions in the ironing operation when such supplies are required for use. Accordingly, the ironing board attachment 11 is mounted to the ironing board 13 adjacent the end 13*e* as is shown in FIGS. 1, 2 and 3. The electric iron used domestically usually takes the form of a steam iron including a self contained water reservoir which provides water for generating steam to facilitate removal of wrinkles. Since the capacity of the reservoir contained within the electric iron is on the order of only 4 ounces, it is frequently necessary to refill the reservoir several times during the ironing operation. Distilled water is commonly purchased in one gallon containers from which it is difficult to pour water into the small fill openings provided in steam irons. It is also impossible to store the one gallon container in a location convenient to the pressing surface.

The ironing board attachment 11 includes a basket 17 which, in accordance with the present invention, may vary as to its size and shape but should preferably be of sufficient size to accommodate the commercially available cans of spray starch, one of which is shown in FIG. 1 and designated by reference numeral 19. The basket 17 preferably includes sufficient space to receive a plastic distilled water container 21 which is similar in size to the starch container 19. The water container 21 preferably accommodates about twenty ounces of water so as to enable the operator to refill the steam iron three to five times during the ironing operation. To permit easy filling from the typical one gallon distilled water bottle, the container 21 has a wide mouth substantially equal to the diameter of the container and includes a removable threaded closure or lid 21*a* to allow it to be filled with distilled water. The closure 21*a* has an integrally formed, tapered pouring spout 21*b* to facilitate pouring the distilled water into the fill opening for the reservoir of the electric pressing iron 15. The basket 17 is generally rectangular in its horizontal cross-section having a bottom 17*a* and side walls 17*b* formed by bars of plastic coated steel wire. The rectangular cross-section is preferably on the order of 4 inches by 8 inches.

The mouth or upwardly facing opening in the basket 17 is defined by a rectangular loop or ring 23 which is secured by welding to a plurality of U-shaped wire members 25 and 27. As best shown in FIGS. 5 and 6, the U-shaped wire members 25 define the longer pair of side walls and the U-shaped wire members 27 define the shorter pair of side walls. The horizontally extending portions of the U-shaped wire members form the bottom 17*a* of the basket 17 with the three members 27 being welded to the seven members 25 where they cross each other at the bottom of the basket 17.

For the purpose of supporting the basket 17, two pairs of the members 25 are formed with upwardly and laterally extending hooks or hook portions 29 as shown in FIGS. 5 and 6. The hook portions 29 are aligned and adapted to receive a support means as will be explained in detail below.

In addition to the basket, the ironing board attachment 11 includes a yoke 31 which comprises a continuous loop of plastic coated steel wire with all the portions of the loop being substantially coplanar. As best shown in FIG. 4, the yoke 31 is formed with a somewhat C-shaped first portion 31 a which is adapted or sized to receive the end of the pressing member 13*a* (shown in dash lines in FIG. 4) and with a second portion 31*b* which projects laterally from the first portion 31*a*. The first portion has a lower rod 33 which is longer than the width of the pressing member 13*a* and a pair of upper rods 35 which are disposed coaxially and are parallel to and spaced from the lower rod 33. The upper rods 35 are spaced from the lower rod 33 a distance which is slightly greater than the thickness of the pressing member 13*a* as is evident from FIG. 4 in which the pressing member is shown in dash lines. The rods 35 are connected to the rod 33 by end rods 37. The yoke 31 is formed by a single length of wire having the ends welded together to form a continuous loop formed in the configuration shown in FIG. 4.

The second portion 31*b* of the yoke 31 includes a support bar 39 which is disposed parallel to the rods 33 and 35 and which serves to pivotally connect the yoke 31 to the basket 17. The support bar 39 is connected to the inner ends of the rods 35 by portions 41 of the yoke 31.

In order to secure the ironing board attachment 11 to the ironing board 13, the yoke 31 is moved onto the end of the pressing member 13*a* with the yoke in the vertical orientation and the pressing member 13*a* extending through the first portion 31*a* of the yoke. After pressing member 13*a* is received in the first portion of the yoke, the yoke is then inclined from the vertical to the position shown in FIG. 3 so that the lower and upper rods 33 and 35 respectively engage the bottom and pressing surfaces of the pressing member 13*a*. The basket 17 is then assembled to the yoke by engaging hook 29 with the support bar 39 of the yoke. This engagement provides a pivotal connection between the basket 17 and the yoke 31 so that the weight of the basket tends to pivot the yoke clockwise as shown in FIG. 3 into engagement with the end 13*e* of the pressing member 13*a*. The weight of the supplies including the starch can 19 and the water container 21 in the basket 17 contributes to the wedging action which tends to lock the yoke 31 in position with respect to the pressing member 13*a*.

As discussed above, the yoke 31 and the basket 17 are formed of plastic coated steel wire. The yoke 31 is preferably made of #4 gage commercial steel wire (5.71 mm in diameter) coated with polyvinyl chloride and the basket 17 is made with the loop 23 being of #9 gage steel wire (3.76 mm dia.) and with the U-shaped members 25 and 27 being of #12 gage steel wire (2.68 mm dia.). The basket parts are first welded together and then coated with PVC material. The plastic coated parts provide an assembly which will not snag or tear the clothes being ironed on the pressing member 13*a*.

The yoke 31 and the basket 17 form an ironing board attachment which is easily assembled to the ironing board 13 after the board has been erected to its horizontal ironing position. The yoke 31 is simply applied over the flat end of the pressing member and the basket 17 is then hooked into engagement with the support bar 39 while the yoke pivots into its locked position as shown in FIG. 3. In this use position, the attachment 11 occupies very little of the usable pressing surface of the ironing board and, at the same time, is conveniently located so that a person ironing at the board 13 may reach the supplies contained in the basket without moving from the location occupied while using the iron 15.

Once the ironing has been completed, the attachment 11 may be easily and simply removed from the ironing board 13 without loosening any screws or clips. The yoke 31 and the basket 17 may be stored easily with no interference to the normal folding and storing of the ironing board 13. The basket 17 provides a convenient mechanism for storing the ironing supplies including the starch and distilled water during the periods between the ironing of clothes. The basket 17 containing the starch and distilled water container 21 may simply be set on a storage shelf since the basket and its contents occupy little more space than the supplies themselves.

What is claimed as new and desired to be secured by Letters Patent of the United States is:

1. An ironing board attachment for conveniently supporting supplies used in pressing clothes on an ironing board of the type having an elongated pressing member with upper and lower surfaces and including a framework supporting said pressing member with the upper surface being a planar surface with a width transverse to an elongated length and disposed horizontally, the combination comprising:

(a) a yoke having a first portion defining an elongated opening which has a length and width to receive an end of an ironing board, said yoke having a second portion which extends laterally from the first portion providing a horizontal basket support bar at said ironing board end when the attachment is assembled to an ironing board, said first and second portions being integrally connected to preclude relative motion between said first and second portions, (b) a basket for receiving ironing supplies having a bottom and sides and having a hook portion for detachable engagement with said support bar to mount said basket in an upright position at said ironing board end with the basket pivotally connected to said support bar and said ironing board end engaged with the side of the basket, (c) said elongated opening in said first portion of said yoke being wider than the spacing between said upper and lower surfaces of said pressing member so that said yoke is easily assembled to said ironing board end when disposed vertically and then pivoted about the length of the elongated opening to engage lengthwise extending edges of said elongated opening with said upper and lower surfaces of said ironing board and to position said support bar over said ironing board end, said basket having a weight which locks said yoke in position on said pressing member.

2. The ironing board attachment of claim 1 wherein said yoke comprises a closed loop of rod-like material disposed in a single plane forming said first and second yoke portions, said elongated opening being defined by a lower rod extending parallel to and spaced from said support bar for engagement with the bottom of said pressing member and by upper rods parallel to and spaced from said lower rod for engagement with said upper surface of said ironing board.

3. The ironing board attachment of claim 2 wherein said rod-like material is plastic coated metal wire, said basket being formed by U-shaped struts of plastic coated wire joined at the ends of their upwardly extending legs to a ring which defines an upper edge of the basket, a pair of horizontally spaced hooks extending outwardly from said ring to detachably engage said support bar.

4. The ironing board attachment of claim 2 wherein the length of said elongated opening is greater than said width of any commercially available domestic ironing boards and wherein said upper rods are disposed coaxially and spaced apart a distance less than said width of the smallest of said domestic ironing boards so that said yoke will be engagable with the lower rod and the upper rods in contact with said lower and upper surfaces respectively of said pressing member.

5. The ironing board attachment of claim 1 including a water container removably supported in said basket, said container having a wide mouth which threadedly receives a closure having an integrally formed pouring spout for dispensing water into an electric steam iron.

6. An ironing board attachment for conveniently supporting supplies used in pressing clothes on an ironing board of the type having an elongated pressing member with a planar upper surface and a lower surface and including a framework supporting said pressing member with the upper surface disposed horizontally, the combination comprising:

(a) a yoke having a first portion defining an opening to receive an end of an ironing board, said yoke having a second portion which extends laterally from the first portion providing a basket support at said ironing board end when the attachment is assembled to an ironing board, said first and second portions being integrally connected to preclude relative movement between said first and second portions, (b) a basket for receiving ironing supplies having a bottom and sides and having a portion for detachable engagement with said support to mount said basket in an upright position at said ironing board end with the basket pivotally connected to said support and said ironing board end engaged with the side of the basket, (c) said opening in said first portion of said yoke being of sufficient size so that said ironing board end is easily inserted into said opening when said yoke is disposed vertically, said yoke being pivotal about a horizontal axis on said upper surface to engage the portions of said yoke defining said opening with said upper and lower surfaces of said ironing board and to lock said yoke with respect to said pressing member with said support positioned over said ironing board end.

7. The ironing board attachment of claim 6 wherein said yoke comprises a closed loop of rod-like material disposed in a single plane forming said first and second yoke portions, said basket support being a support bar, said opening being elongated and defined by a lower rod extending parallel to and spaced from said support bar for engagement with the bottom of said pressing member and by upper rods parallel to and spaced from said lower rod for engagement with said upper surface of said ironing board.

8. The ironing board attachment of claim 6 wherein said first and said second portions of said yoke are coplanar.

9. The ironing board attachment of claim 8 wherein said yoke is formed by a continuous loop of plastic coated wire, said loop defining said opening which is elongated, said support being an elongated bar which extends parallel to said elongated opening.

10. The ironing board attachment of claim 9 wherein said basket is formed by U-shaped struts of plastic coated wire joined at the ends of upwardly extending legs to a ring which defines an upper edge of the basket, a pair of horizontally spaced hooks extending outwardly from said ring to detachably engage said elongated bar.

11. An ironing board attachment for conveniently supporting supplies used in pressing clothes on an ironing board of the type having an elongated pressing member with a planar upper surface and a lower surface and including a framework supporting said pressing member with the upper surface disposed horizontally, the combination comprising:

(a) an open mouthed basket for receiving a starch spray container and a distilled water container having an elongated pouring spout, said basket having side walls and a bottom wall, (b) a rigid one piece basket support having a first end and a second end with an opening in said first end which losely receives the end of an ironing board pressing member, said support being pivotal about said opening to wedge said support with respect to said pressing member to prevent displacement lengthwise of said pressing member, (c) said support and said basket having separable coupling means to pivotally connect said second end of said support and said basket to hang said basket in contact with an end of said pressing member.

* * * * *